US005821694A

United States Patent [19]

Young

[11] Patent Number: 5,821,694

[45] Date of Patent: Oct. 13, 1998

[54] METHOD AND APPARATUS FOR VARYING ACCELERATOR BEAM OUTPUT ENERGY

[75] Inventor: Lloyd M. Young, Los Alamos, N. Mex.

[73] Assignee: The Regents of the University of California, Los Alamos, N. Mex.

[21] Appl. No.: 640,640

[22] Filed: May 1, 1996

[51] Int. Cl.[6] ..... H05H 9/04

[52] U.S. Cl. ..... 315/5.41; 315/500; 315/505

[58] Field of Search ..... 315/5.41, 5.42, 315/500, 505

[56] References Cited

U.S. PATENT DOCUMENTS

| | | | |
|---|---|---|---|
| 4,286,192 | 8/1981 | Tanabe et al. | 315/5.41 |
| 4,382,208 | 5/1983 | Meddaugh et al. | 315/5.41 |
| 4,629,938 | 12/1986 | Whitham | 315/5.41 |
| 4,651,057 | 3/1987 | Vetomi et al. | 315/5.41 |
| 4,746,839 | 5/1988 | Kazusa et al. | 315/5.41 |

FOREIGN PATENT DOCUMENTS

| | | | |
|---|---|---|---|
| 77203 | 3/1989 | Japan | 315/5.41 |

*Primary Examiner*—Benny T. Lee
*Attorney, Agent, or Firm*—Ray G. Wilson

[57] ABSTRACT

A coupled cavity accelerator (CCA) accelerates a charged particle beam with rf energy from a rf source. An input accelerating cavity receives the charged particle beam and an output accelerating cavity outputs the charged particle beam at an increased energy. Intermediate accelerating cavities connect the input and the output accelerating cavities to accelerate the charged particle beam. A plurality of tunable coupling cavities are arranged so that each one of the tunable coupling cavities respectively connect an adjacent pair of the input, output, and intermediate accelerating cavities to transfer the rf energy along the accelerating cavities. An output tunable coupling cavity can be detuned to variably change the phase of the rf energy reflected from the output coupling cavity so that regions of the accelerator can be selectively turned off when one of the intermediate tunable coupling cavities is also detuned.

6 Claims, 5 Drawing Sheets

METHOD AND APPARATUS FOR VARYING ACCELERATOR BEAM OUTPUT ENERGY

BACKGROUND OF THE INVENTION

This invention relates to charged particle accelerators, and more particularly, to charged particle coupled cavity accelerators having a variable output energy. This invention was made with government support under Contract No. W-7405-ENG-36 awarded by the U.S. Department of Energy. The government has certain rights in the invention.

The coupled cavity accelerator (CCA) is the most commonly used medical accelerator, with more than 3000 in use. Applications of these accelerators require a stable high-output X-ray beam at widely separated energies, with a concomitant requirement for an accelerator that can switch readily and quickly between the different energies. One technique is clearly to vary the input rf energy to affect the accelerating gradients and fields in all of the accelerating cavities forming the accelerator.

Other techniques have been used to switch energy in standing-wave accelerators by introducing local effects:

1. U.S. Pat. No. 4,286,192, issued Aug. 25, 1981, to Tanabe et al., teaches changing the radio frequency (rf) mode in a coupling cavity, thereby reversing the field direction in part of the accelerator. The reversal of the field acts to decelerate the beam in that part of the accelerator.

2. U.S. Pat. No. 4,382,208, issued May 3, 1983, to Meddaugh et al., discloses changing the electromagnetic field distribution within a coupling cavity to vary the accelerating fields in part of the accelerator.

3. U.S. Pat. No. 4,629,938, issued Dec. 16, 1986, to Whitham, provides for detuning a coupling cavity to decrease the electric field in the part of the accelerator downstream from the detuned coupling cavity.

4. U.S. Pat. No. 4,746,839, issued May 24, 1988, to Kazusa et al., teaches the use of two coupling cavities in place of a single cavity. One of the other of the cavities is shorted at any one time to switch between two possible transmitted electric fields and affect the fields downstream of the dual coupling cavities.

These techniques for changing the energy of medical electron accelerators have disadvantages. The simplest method changes the energy by changing the accelerating gradient in the entire accelerator; but his method only provides good beams at medium energies. Using the other techniques described in the above publications can result in beam instabilities at high currents.

It is desirable to maintain the proper fields in the front end of a medical electron accelerator for good capture of the injected beam and maintain a small energy spread in the output beam. It is essential to maintain the proper fields in a proton accelerator because the beam would lose synchronism with the accelerating fields and not be properly accelerated.

Accordingly, it is an object of the present invention to provide a CCA that can maintain beam stability while switching the output energy of the particle beam.

Another objective of the present invention is to maintain accelerating gradients and electromagnetic fields in a CCA while varying the output energy of a charged particle beam.

Still another objective of the present invention is to maintain beam quality in a CCA while varying the output energy of a charged particle beam.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a coupled cavity accelerator (CCA) for accelerating a charged particle beam with rf energy from a rf source. An input accelerating cavity receives the charged particle beam and an output accelerating cavity outputs the charged particle beam at an increased energy. Intermediate accelerating cavities connect the input and the output accelerating cavities to accelerate the charged particle beam. A plurality of tunable coupling cavities are arranged so that each one of the tunable coupling cavities respectively connects adjacent pairs of the input, output, and intermediate accelerating cavities to transfer the rf energy along the accelerating cavities. An output tunable coupling cavity is connected to variably change the phase of the rf energy reflected from the output coupling cavity, whereby tuning the output tunable coupling cavity to a nominal tuning frequency and detuning one of the tunable coupling cavities causes ones of the intermediate accelerating cavities between the output tunable coupling cavity and the one of the tunable coupling cavities to have an accelerating rf field of essentially zero magnitude.

In another characterization of the present invention, the output energy of a charged particle beam from a coupled cavity accelerator (CCA) is varied where the CCA uses rf energy from a rf source to accelerate the charged particles and has an input accelerating cavity for receiving the charged particle beam, intermediate accelerating cavities for accelerating the charged particle beam, and a plurality of tunable coupling cavities for transferring energy along the accelerating cavities. An output accelerating cavity outputs the charged particle beam; and an output tunable coupling cavity is connected to variably change the phase of the rf energy reflected from the output coupling cavity, whereby tuning of the output tunable coupling cavity to a nominal tuning frequency and one of the tunable coupling cavities causes ones of the intermediate accelerating cavities between the output tunable coupling cavity and the detuned tunable coupling cavities to have an accelerating rf field of essentially zero magnitude.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

In accordance with the present invention, a tunable coupling cavity is provided on the output side of a terminal accelerating cavity in a coupled cavity accelerator (CCA) for accelerating charged particles. As used herein, a coupled cavity accelerator is either a coupled cavity linear accelerator or a coupled cavity drift tube linear accelerator. A coupling cavity is a cavity on the side of an accelerator for electromagnetic field coupling between adjacent accelerating cavities. No portion of the particle beam goes through the coupling cavities. As further explained below, the effect of the output coupling cavity on the terminal (or end) accelerating cavity is to allow regions of the accelerator to be incrementally "turned off" by variably changing the phase of the reflected rf power. The reflected rf power destructively combines in the accelerating cavities to reduce the accelerating electromagnetic field essentially to zero in the turned-off region of the accelerator.

As used herein, except as specifically identified, the component parts of the CCA are well known in the art. For example, accelerating cavity designs and tunable coupling cavity designs are described in the Tanabe et al., Meddaugh et al., and Whitham patents, supra, all incorporated herein by reference, and such component parts may be used in a CCA according to the present invention. Thus, the present invention is described by the functional interaction between the various accelerating cavities and tunable coupling cavities and not by the detailed design of the component parts.

Figure 1:
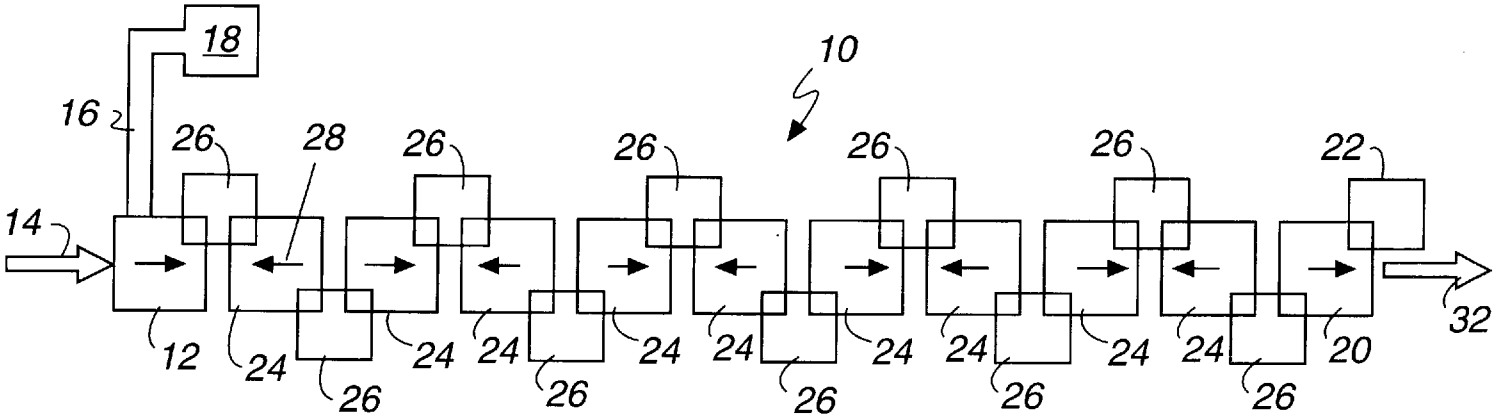
FIG. 1 is a block diagram picture of one embodiment of a CCA according to the present invention which is tuned for full accelerator output energy.
Figure 2:
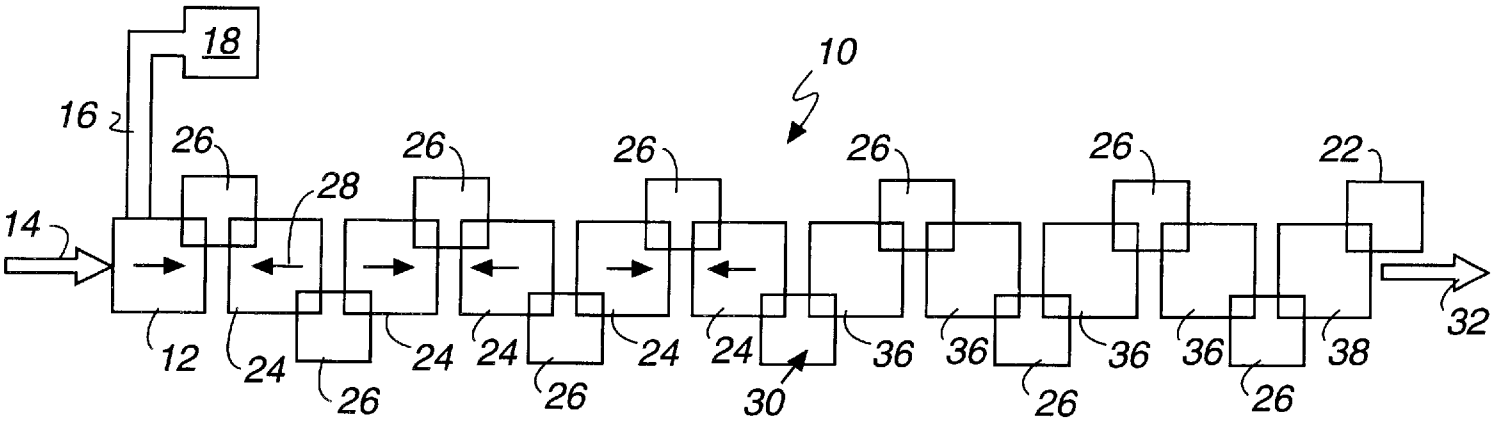
FIG. 2 is a block diagram picture of the accelerator shown in FIG. 1 which is tuned to turn off the last five accelerating cavities of the CCA.

Referring first to FIGS. 1 and 2 there are depicted block diagrams of a CCA according to one embodiment of the present invention. CCA structure 10 has input accelerating cavity 12 connected to receive an input charged particle beam 14 from a source (not shown). In one configuration radio frequency (rf) energy is input through wave guide 16 from rf source 18, which may be a magnetron or the like. In other embodiments, rf energy may be input through other accelerating cavity sections and the location of the rf source is not critical, provided the input is upstream from the longest section to be turned off according to this invention. It should be noted that the terms "upstream" and "downstream" as used herein are relative to the direction of the charged particle movement, e.g., from left to right in FIGS. 1 and 2.

A plurality of accelerating cavities 24 (FIG. 1), 36 (FIG. 2) are serially connected to input cavity 12, with a terminal cavity 20 (FIG. 1), 38 (FIG. 2) for outputting the accelerated charged particle beam 32. In accordance with the present invention, all of the intermediate cavities 24, 36 are of the same design. Each intermediate coupling cavity 24, 36 has a coupling cavity 26 to receive energy from an upstream accelerating cavity and a coupling cavity 26 to transfer energy to a downstream coupling cavity. Input accelerating cavity 12 is not connected to an upstream coupling cavity and the terminal accelerating cavity 20, 38 is not connected by end coupling cavity 22 to a downstream accelerating cavity.

In order to better understand the present invention, the operation of a conventional CCA will be first described with reference to FIG. 1. CCA 10 is excited with rf energy through waveguide 16 from rf source 18, which may be a magnetron that outputs microwaves. In one embodiment, the rf energy is input to input accelerating cavity 12 and forms a standing wave along CCA structure 10, which forms a suitable resonant structure. The resonant rf fields interact with the charged particles of beam 14 to accelerate the particles to essentially the velocity of light at the output from terminal accelerating cavity 20.

Tunable coupling cavities 26 are generally described as side-coupled cavities and are disposed off-axis from accelerating cavities 24. Each one of coupling cavities 26, 22 includes conventional structure for tuning the cavity into and out of resonance with the input rf. As used herein, the term "nominal tuned frequency" means the tuned frequency that is resonant with the standing wave. Generally, coupling cavities 26 are tuned to the same resonant frequency as accelerating cavities 24. At an instant of time, the direction of the rf field in accelerating cavities 12, 20, and 24 is shown by the arrows, e.g., representative arrow 28. Accelerating cavities 12, 20, and 24 are formed so that the charged particles (at velocities near the speed of light) travel from one cavity to another in ½ rf cycle, so that after being accelerated in one cavity the particles arrive at the next cavity when the direction of the field there has been reversed and the particles are again in an accelerating field direction. The field in each coupling cavity 26 is advanced in phase by $\pi/2$ radians from the preceding accelerating cavity 24 so the complete periodic resonant structure operates in a mode with a $\pi/2$ phase shift per cavity. Since the beam does not interact with the coupling cavities, the beam sees the equivalent of a $\pi$ radians phase shift between adjacent accelerating cavities.

In accordance with the present invention, an additional coupling cavity 22 is provided at the output of terminal accelerating cavity 20, 38. When coupling cavity 22 is detuned to a frequency above the nominal frequency of intermediate cavities 24 the rf is reflected by the detuned coupling cavity with the proper phase so the CCA operates conventionally, with all of accelerating cavities 12, 20, 24 contributing to the acceleration of the particle beam. A preferred frequency for detuning cavity 22 is about 10% above the nominal frequency for the remaining cavities.

The significance of the effect of the variable change in the phase of the rf reflected from end coupling cavity 22 becomes apparent when the output of CCA 10 is to be changed. Now end coupling cavity 22 is tuned to the nominal frequency for coupling cavities 26. As shown in FIG. 2, intermediate coupling cavity 30 is detuned to a frequency about 10% above the nominal coupling cavity frequency. Again, the rf energy is reflected by the detuned coupling cavity and very little power is passed on to the rest of the accelerator. The presence of end coupling cavity 22 acts to eliminate the $\pi/2$ mode in the accelerating cavities 36 downstream of detuned coupling cavity 30. It will be understood that only a selected number of coupling cavities 26 may be provided as tunable cavities. The tunable cavities are placed within CCA structure 10 at locations effective to provide the desired incremental energy variation.

Referring now to FIG. 2, another way to view the effect of end coupling cavity 22 is to analyze what happens when a traveling wave reflects from end accelerating cavity 38. Without end coupling cavity 22, i.,e., with end coupling cavity 22 detuned from the nominal tuned frequency of intermediate accelerating cavities 24, as explained above, the reflected wave will add constructively in the accelerating cavities 36 between cavity 30 and cavity 38 and destructively in the respective coupling cavities. However, with end coupling cavity 22 tuned to the nominal tuned frequency of the intermediate accelerating cavities, as discussed above, the reflected wave will add constructively in the coupling cavities and destructively in the accelerating cavities 36. Thus, the rf fields do not build up to any significant degree in accelerating cavities 36 and the energy of the beam can not change in the section of the CCA that is "turned off" by this detuning method.

Figure 3:
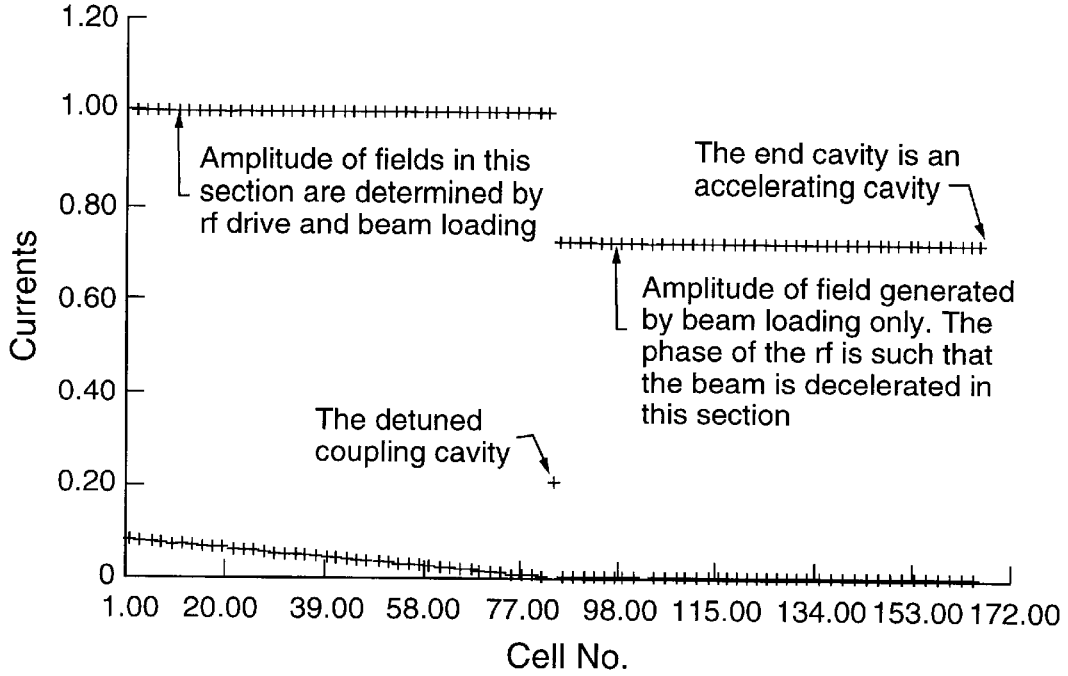
FIG. 3 graphically depicts the effect of detuning an intermediate coupling cavity without an end coupling cavity.
Figure 4:
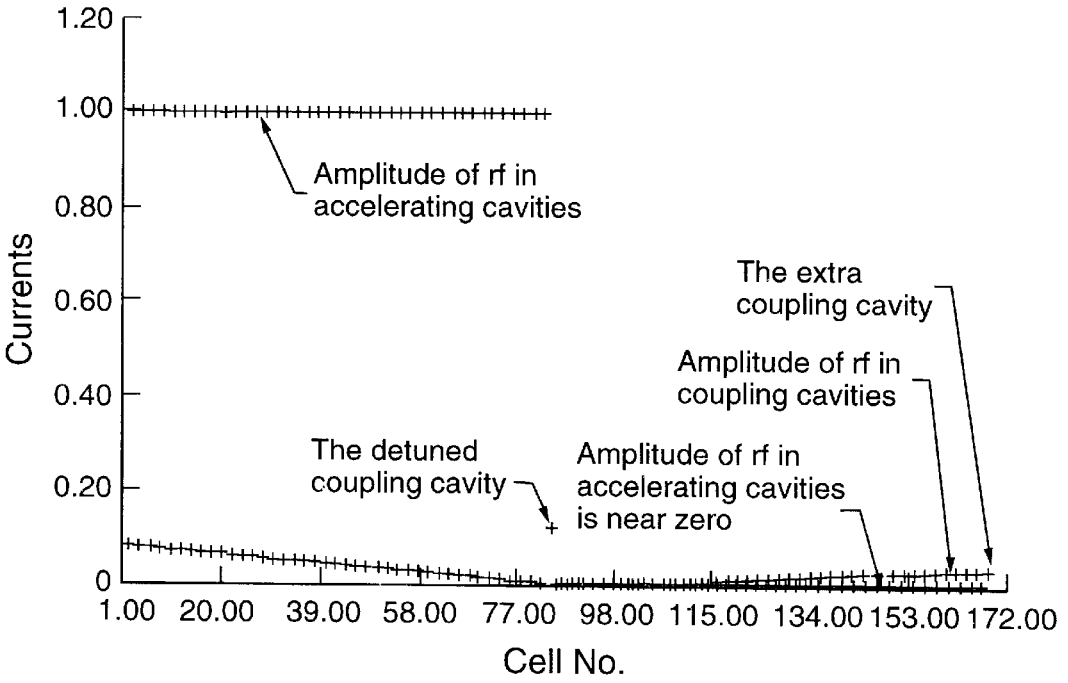
FIG. 4 graphically depicts the effect of detuning an intermediate coupling cavity with an end coupling cavity.

FIGS. 3 and 4 graphically depict the effect of the end coupling cavity 22 (FIGS. 1 and 2) that is configured as an accelerating cavity. As shown in FIG. 3, the amplitude of the rf fields in the section of the CCA upstream of the detuned coupling cavity are determined by the rf drive and by the beam loading. The amplitude of the rf in the coupling cavity decreases to the detuned coupling cavity. The amplitude of the rf fields in the downstream accelerating cavities is the field generated only by beam loading, where the end cavity is an accelerating cavity. The phase of the rf is such that the beam is decelerated in this section.

FIG. 4 graphically depicts the effect of beam loading in a CCA with the right half "turned off," i.e., extra end coupling cavity 22 (FIGS. 1 and 2) is included and tuned to the nominal tuned frequency when coupling cavity 30 (FIG. 2) is tuned about 10% above the nominal frequency. Again, the amplitude of the rf in the upstream coupling cavities is determined by the rf drive and beam loading and the amplitude of the rf fields in the coupling cavities decreases toward the detuned coupling cavity. Now, however, the amplitude of the rf in the downstream accelerating cavities 36 (FIG. 2) is near zero and the amplitude of the rf in the downstream coupling cavities 26 (FIG. 2) is small.

One of the effects of turning off a section of the accelerator is the increase in the coupling factor ($\alpha$) of the rf drive to the accelerator. For example, if half of the accelerator is turned off, $\alpha$ will increase by a factor of 2. Finally, if end accelerating cavity 20, 38 is tuned to the same frequency as the other accelerating cavities 26, 36, end coupling cavity 22 can be the same tunable coupling cavity design that is used for all of the coupling cavities 26, 36 (FIGS. 1 and 2) wherein the tuning only has to raise the frequency by about 10% to turn off the selected section of the CCA.

Figure 5:
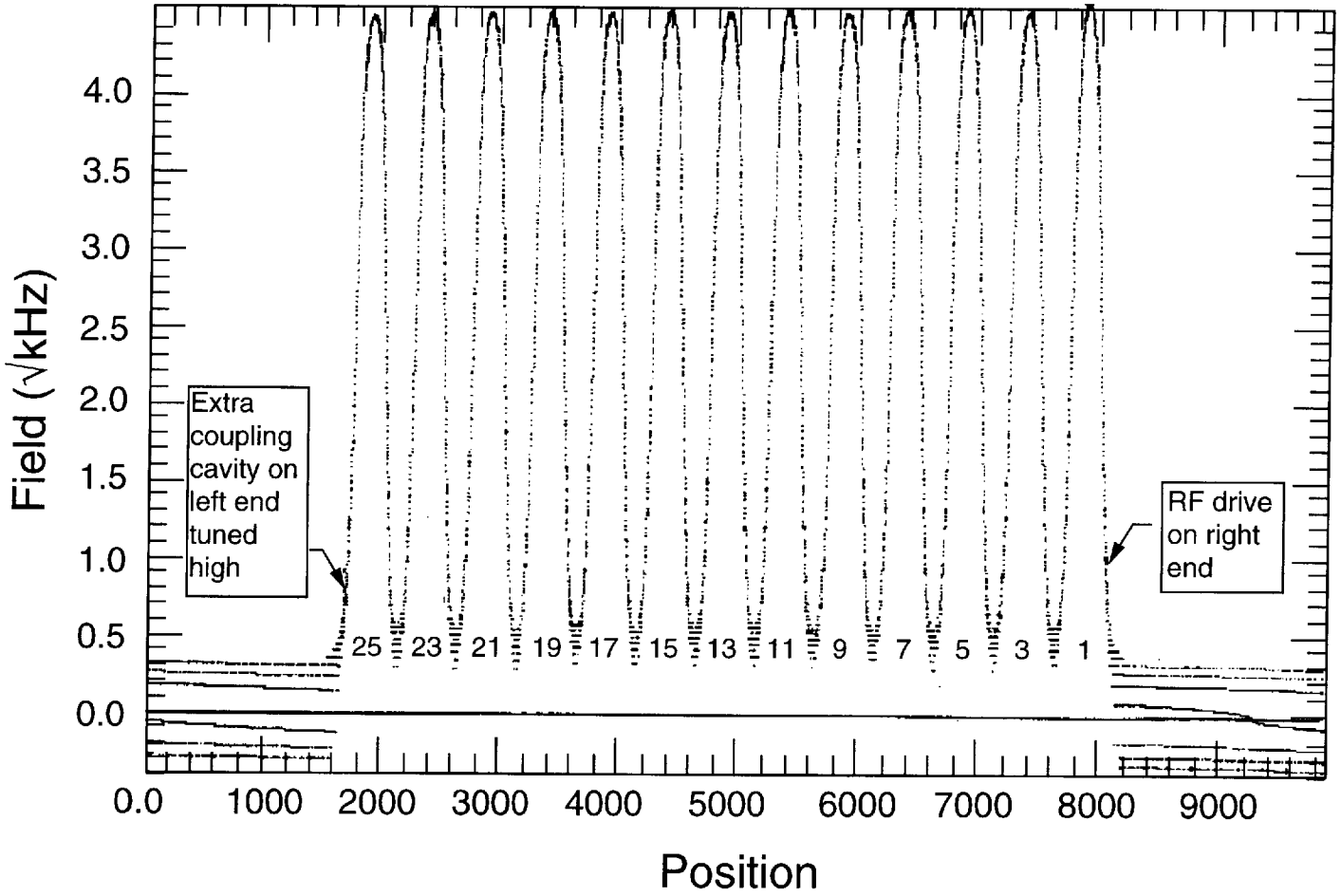
FIG. 5 graphically depicts the accelerating fields in accelerating cavities with the end coupling cavity tuned to a frequency above the nominal frequency in the intermediate coupling cavities.

An experiment was performed on the Los Alamos Meson Physics Facility (LAMPF) prototype side coupled linac to verify the technique of "turning off" part of a coupled cavity linac (CCL) by detuning a coupling cavity. FIG. 5 shows a beam perturbation measurement of the CCL with fields in all of the accelerating cavities (denoted by odd cell numbers 1–25, where the coupling cavities would have even numbers up to 26). RF fields are introduced from an RF drive on the right end of the linac. This section of the CCL has an extra end coupling cavity (cell 26) on the left hand side of the accelerator that is tuned to a frequency higher than resonance. The CCL resonant frequency was 804.8900 MHz and the end coupling cavity was tuned to 891.5 MHz, as determined by an analysis program LOOP, a software routine for analyzing coupled RLC circuit loops. The accelerating rf field is introduced into accelerating cavity 12 and is seen to be present in all of the accelerating cavities.

Figure 6:
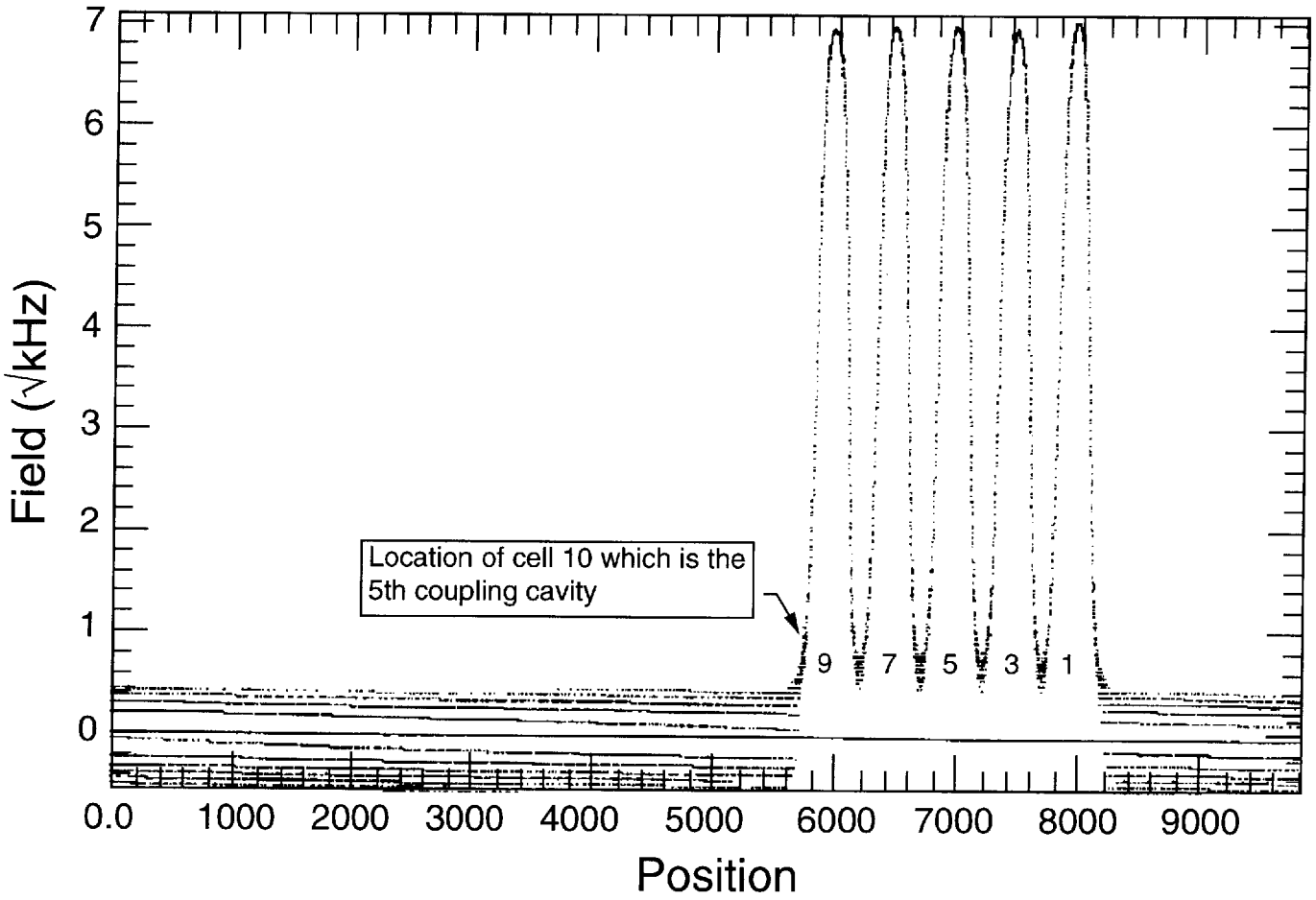
FIG. 6 graphically depicts the accelerating fields in accelerating cavities with an intermediate cavity tuned to a frequency above the nominal frequency in the other intermediate coupling cavities and with the end coupling cavity tuned to the nominal frequency.

FIG. 6 graphically depicts the experimental set up with cell 10 (the fifth coupling cavity from the right) tuned to 890.5 MHz and the end coupling cavity was tuned to 804.8900 MHz. It is now seen that the accelerating cavities upstream of cell 10 (denoted by odd cell numbers 1–9) have rf fields, while all of the accelerating cavities to the left of cell 10 have no rf field. This experiment was performed again with coupling cavity number 14 (cavity at the location between cells 13 and 15 in FIG. 5) detuned to 890.5 MHz with the same results as shown in FIG. 6, i.e., there was no rf field in the cavities downstream from cell 14.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A coupled cavity accelerator (CCA) operating at a nominal tuned frequency for accelerating an input charged particle beam with rf energy from a rf source, the accelerator comprising:

an input accelerating cavity for receiving said input charged particle beam;

an output accelerating cavity for outputting an output charged particle beam having an energy greater than said input charged particle beam;

intermediate accelerating cavities respectively connecting said input and said output accelerating cavities for accelerating said input charged particle beam;

a plurality of tunable coupling cavities, each one of said tunable coupling cavities respectively connecting a corresponding adjacent pair of said input, output, and intermediate accelerating cavities and, thence, to said output accelerating cavity to transfer said rf energy from said input accelerating cavity to said intermediate accelerating cavities; and an output tunable coupling cavity connected to said accelerating output cavity for variably changing the phase of said rf energy when said rf energy is reflected from said output tunable coupling cavity, so that tuning of said output tunable coupling cavity to said nominal tuned frequency and detuning one of said tunable coupling cavities to a frequency above said nominal tuned frequency causes ones of said intermediate accelerating cavities located between said output tunable coupling cavity and said one of said tunable coupling cavities to have an accelerating rf field of essentially zero magnitude.

2. A CCA according to claim 1, wherein said output tunable coupling cavity is capable of being detuned at least about 10% higher in frequency than said nominal tuned frequency.

3. A CCA according to claim 2, wherein a selected number of said tunable coupling cavities are each capable of being detuned at least about 10% higher in frequency than a nominal tuned frequency for associated with said intermediate accelerating cavities.

4. A CCA according to claim 1, wherein a selected number of said tunable coupling cavities are each capable of being detuned at least about 10% higher in frequency than a nominal tuned frequency associated with said intermediate accelerating cavities.

5. A method for varying output energy of a charged particle beam from a coupled cavity accelerator (CCA)

operating at a nominal tuned frequency using rf energy from a rf source to accelerate said charged particles and having an input accelerating cavity for receiving said charged particle beam, intermediate accelerating cavities for accelerating said charged particle beam, an output accelerating cavity for outputting said charged particle beam, and a plurality of tunable coupling cavities connected for transferring rf energy along said accelerating cavities, said method comprising the steps of:

providing an output tunable coupling cavity connected to said output accelerating cavity to variably change the phase of said rf energy when said rf energy is reflected from said output tunable coupling cavity; and tuning said output tunable coupling cavity to said nominal tuned frequency and detuning one of said tunable coupling cavities to a frequency above said nominal tuned frequency so that ones of said intermediate accelerating cavities located between said output tunable coupling cavity and said one of said tunable coupling cavities have an accelerating rf field of essentially zero magnitude.

6. A method according to claim 5, further comprising the steps of detuning said output tunable coupling cavity to a frequency at least about 10% higher than said nominal tuned frequency.

* * * * *